US007047601B1

(12) United States Patent
Vernon-Woods

(10) Patent No.: US 7,047,601 B1
(45) Date of Patent: May 23, 2006

(54) SPRAY APPLICATOR BELT HOOK

(76) Inventor: Donald Michael Vernon-Woods, 2 McBryde Ct., Para Hills West, Adelaide SA (AU), 5096

( * ) Notice: Subject to any disclaimer, the term of this patent is extended or adjusted under 35 U.S.C. 154(b) by 0 days.

(21) Appl. No.: 09/531,769

(22) Filed: Mar. 21, 2000

(51) Int. Cl.
*A44B 21/00* (2006.01)

(52) U.S. Cl. ..... 24/3.12
(58) Field of Classification Search ..... 24/3.6, 24/3.12, 904
See application file for complete search history.

(56) References Cited

U.S. PATENT DOCUMENTS 2,320,450 A * 6/1943 Valenzuela ..... 24/3.12 X
2,775,804 A * 1/1957 Ayoub ..... 24/3.6
2,832,114 A * 4/1958 Mead ..... 24/10 R
4,587,818 A * 5/1986 Griffin ..... 24/3.6
4,638,530 A * 1/1987 Perry ..... 24/3.12
5,509,632 A * 4/1996 Mesna et al. ..... 248/301
5,619,774 A * 4/1997 Perry ..... 24/3.6
5,628,432 A * 5/1997 Mosley ..... 222/175
6,032,337 A * 3/2000 Rankin, Jr. et al. ..... 24/3.12
6,105,923 A * 8/2000 Robertson et al. ..... 24/3.12 X

* cited by examiner

*Primary Examiner*—Robert J. Sandy

(57) ABSTRACT

A Spray Applicator Belt Hook for use in conjunction with spray applicator bottles. These bottles are usually of 500 mL or 1 L capacity; usually contain a chemical or liquid substance for use in cleaning, gardening or other duties whereby the belt hook allows the user to carry the spray bottle on their belt when not in use.

5 Claims, 4 Drawing Sheets

SPRAY APPLICATOR BELT HOOK

CROSS-REFERENCES TO RELATED APPLICATIONS

This application is related to Australian Application 475/1999, filed Feb. 17, 1999, entitled "Spray Applicator Belt Hook".

BACKGROUND OF THE INVENTION

The spray applicator belt hook was initially designed to fill a need in the cleaning industry where cleaning staff were losing time having to walk back to their trolley to fetch their spray bottle (applicator), or, if taking it with them into the office to be cleaned, would be left with only one free hand to work with. Many spray bottles have been lost when put down and forgotten, or left behind at the end of a shift only to be found by office staff returning to work on the following day. This problem also created the possibility of office staff coming into contact with chemicals they have no understanding of and which if used incorrectly could cause injury to the person misusing them. The spray applicator belt hook overcomes these problems.

SUMMARY

An object of the present invention is to provide a spray applicator belt hook for use in conjunction with spray applicator bottles. These bottles are usually of 500 ml or one liter capacity, and usually contain a chemical or liquid substance for use in cleaning, gardening or other duties whereby the belt hook allows the user to carry the spray bottle on their belt when not in use.

DETAILED DESCRIPTION OF THE INVENTION

The spray application belt hook is a double U-shaped piece of polypropylene which slips over the belt of an operator allowing the operator to carry a spray bottle with them where ever they go eliminating wasted time walking back to the trolley and minimizing the incidents of lost bottles and the possibility of injury to untrained persons.

Trials of the belt hook over the past year in the working environment have demonstrated a labor cost saving to the contractor of 6%, happier cleaning staff and no lost spray bottles.

The belt hook would not necessarily be restricted in application just to the cleaning industry. The Belt Hook would be a useful adjunct to any endeavor where a spray applicator is being used.

The spray applicator belt hook is made in one piece of polypropylene through a process of injection molding. It has a double U-shaped configuration set in opposing directions. The body of the belt hook is a modified belt clip with an added platform, called the rest, set at 90 degrees to the clip. At the end of the rest is a vertical projection set at 90 degrees to the Rest called the rest guard.

The rest and rest guard support a spray applicator bottle under the sprayer trigger mechanism while the belt clip supports the whole on the users belt. The angle of the rest has been calculated to conform with the angle of the sprayer trigger mechanism which is a constant angle on most generic spray applicators.

Figure 1:
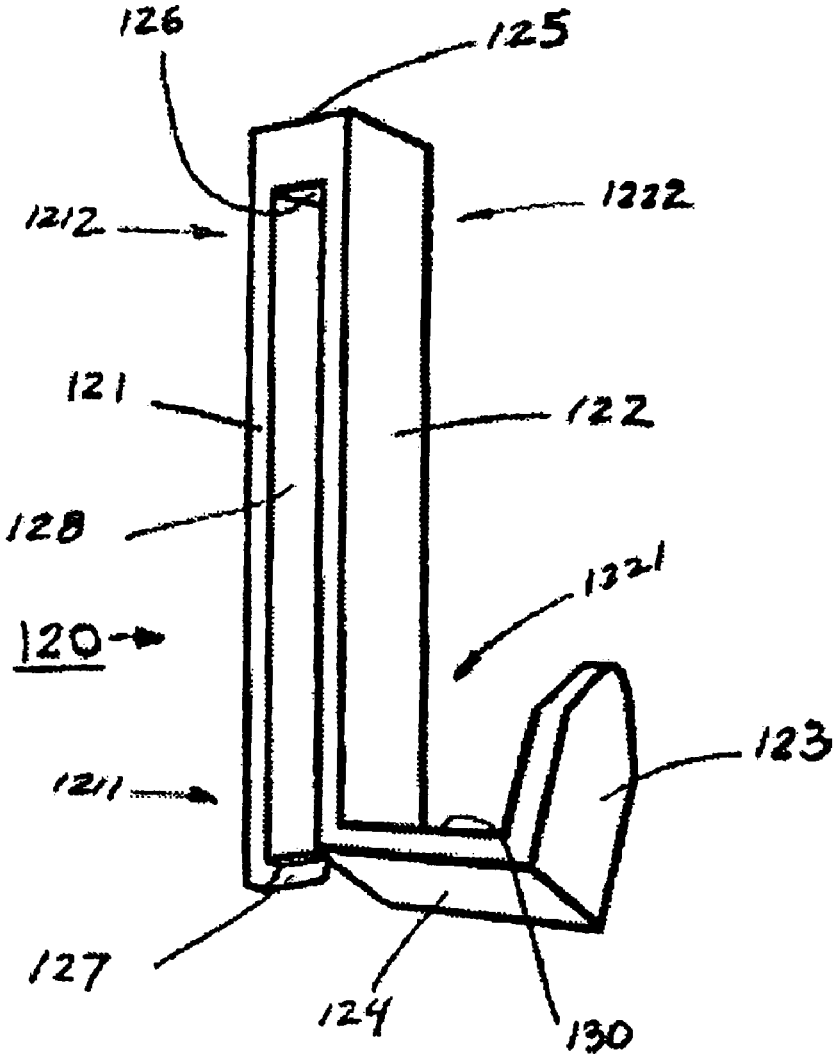
FIG. 1 is a perspective view of the present invention.
Figure 2:
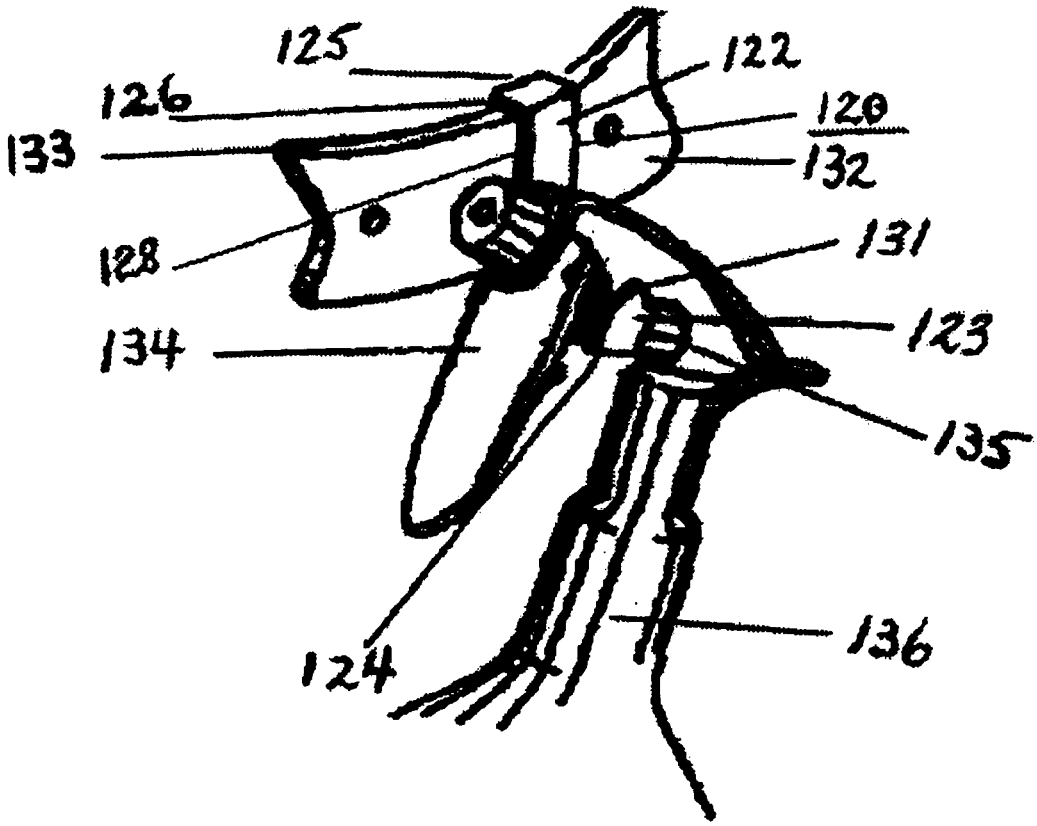
FIG. 2 is a perspective view illustrating the use of the present invention.
Figure 4:
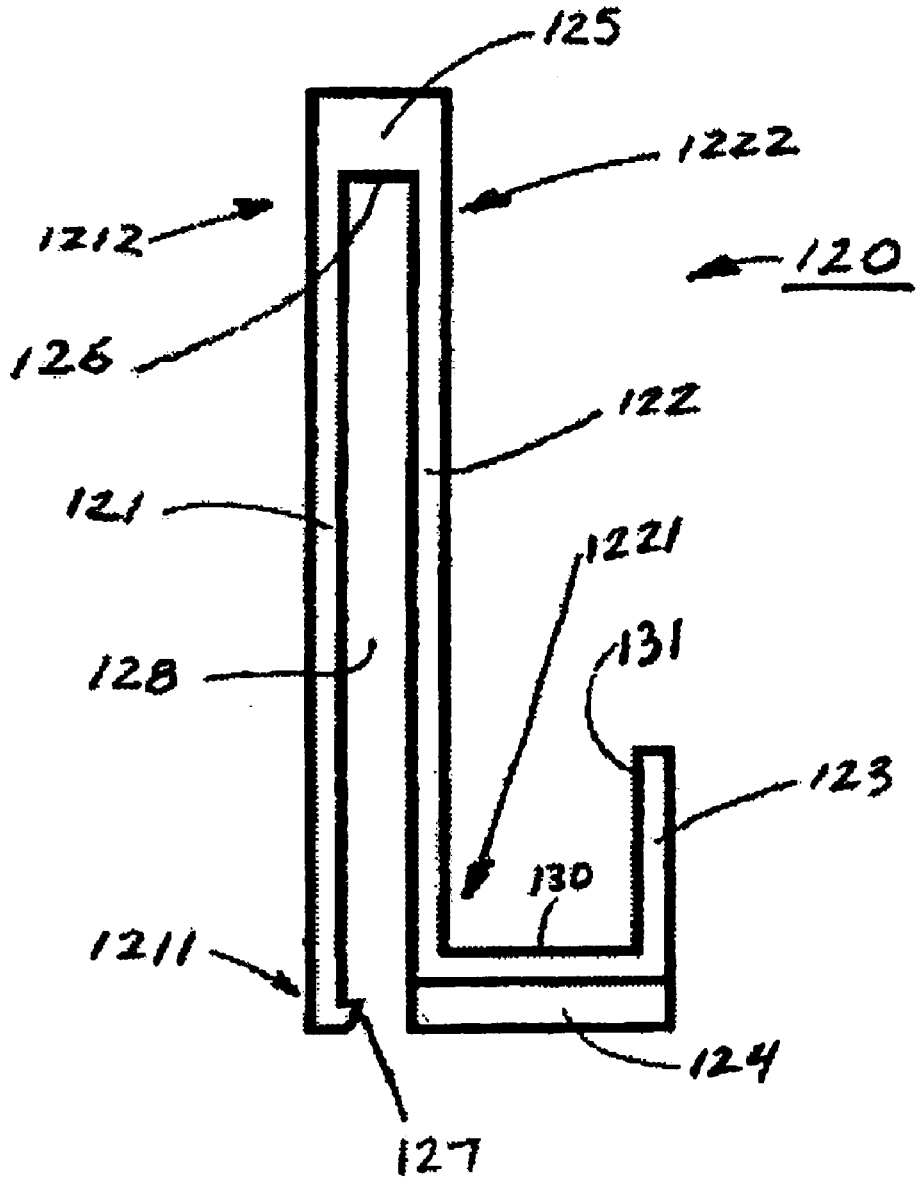
FIG. 4 is a front elevation illustrating the invention.

Referring to FIGS. 1 and 4, where the spray applicator belt hook is shown as 120 and is in perspective view, it can be seen that the spray applicator belt hook has a belt retaining portion and an article supporting portion. The article shown in FIG. 2 is a spray that is usually of 500 ml or one liter capacity. The belt retaining portion including a rear body wall 121, a front body wall 122, and a bridge 125. The rear body wall 121 having a free end 1211 and an top end 1212 opposite from the free end 1211 The free end 1211 having a small protuberance 127 extending therefrom that fits beneath the bottom edge of a wearers belt 132 (FIG. 2). The front body wall 122 having a top end 1222 and a bottom end 1221 opposite from the top end 1222. The bridge 125 is integrally joined to each of the top end 1212 of the rear body wall 121 and to the top end 1222 of the front body wall 122 thereby bridging the two walls 121, 122 at their respective top ends 1212, 1222. The bridge 125 includes a bottom surface that defines a resting surface 126. The resting surface 126 of the bridge 125 and the adjoining front body wall 122 to the rear body wall 121 forms an aperture 128 below the bridge 125 which sits atop the wearers belt 133 (FIG. 2) with the belt 132 passing through the aperture 128.

The article supporting portion being integrally joined to the belt retaining portion. The article supporting portion having an angular rest 124 and a rest guard 123. The angular rest 124 having an innermost joining portion and an outermost joining portion laterally spaced from each other, where the innermost joining portions is integrally joined to and extending outward from the bottom end 1221 of the front wall 122 of the belt retaining portion thereby integrally joining the article supporting portion to the belt retaining portion. The angular rest 124 which faces outward from the wearers body is positioned at a 25 degree angle from a horizontal plane the is made from the rest 126 of bottom surface of the bridge 125. This angular rest 124 conforms to the slope of a plunger mechanism 135 (FIG. 2) of a spray applicator bottle 136 (FIG. 2) and facilitates the support of the spray applicator bottle 136 on the upper portion of a rest surface 130. At the outermost joining portion of the angular rest 124 and extending at a right angle to the angular rest 124 is a vertical section which acts as a rest guard 123 and which retains the spray applicator bottle 136 on the uppermost surface 130 of the angular rest 124 and against an inner surface 131 of the rest guard 123, as shown in FIG. 2.

FIG. 2 depicts a belt 132 fitted with the spray applicator belt hook 120 where the belt passes through the aperture 128 of the belt hook formed by the two opposed body walls 121 and 122 (FIG. 1) and supported by the top 133 of the belt 132 and by the underside of the bridge 125 at rest 126 at the top of the aperture 128. The spray applicator bottle 136 is then supported under it's pressure plunger mechanism 135 and to the rear of the trigger mechanism 134 and on the uppermost part of the rest surface 130 (FIG. 1) and against the inner surface 131 of the rest guard 123. This allows the spray applicator unit to be easily carried by the user on the users belt when the spray applicator is not being used leaving both hands free for other tasks to be carried out.

Figure 3:
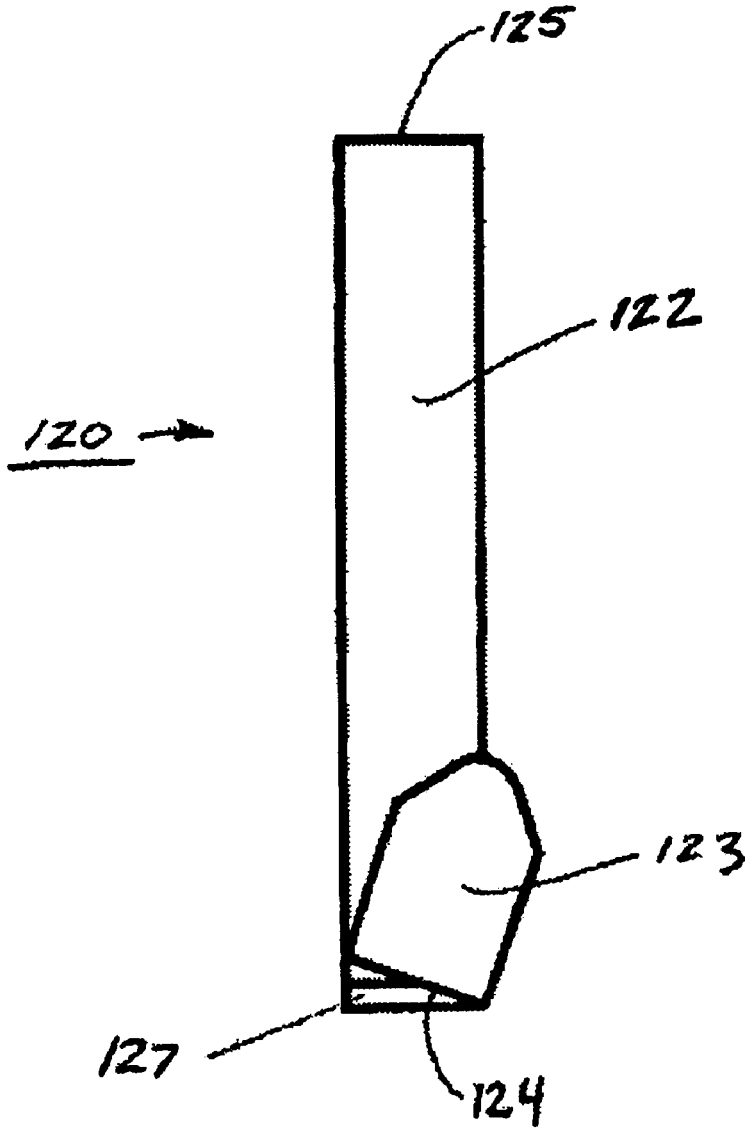
FIG. 3 is a side elevation thereof.

FIG. 3 shows where rest guard 123 and angular rest 124 are each positioned an a 25 degree angle from the horizontal plane that is made from the resting surface 126 of the bridge 125. Angular rest 124 and rest guard are each shown as planar members. FIG. 4 shows where walls 121 and 122 are each planar members spaced parallel from each another.

Preferably, the spray applicator belt hook has an overall length of 117 mm, a body width of 21 mm, a rest width of 20 mm, a rest guard length of 30 mm, the rest angle to the body of 25 degrees, and a material thickness of 3 mm. The spray applicator belt hook as shown in the drawing figures illustrates a left hand model where in FIG. 3 the article supporting portion (i.e., 123, 124) is angled clockwise from the belt retaining portion (i.e., 121, 122, 125). And while left and right handed models will be manufactured, it is assumed that a right handed model (not shown) would constitute an obvious alternate embodiment of the present invention where the article supporting portion is angled anticlockwise from the belt retaining portion.

A listing describing the drawing reference numerals is as follows:

120 spray applicator belt hook
121 rear body wall
1211 free end of rear body wall
1212 top end of rear body wall
122 front body wall
1221 bottom end of front body wall
1222 top end of front body wall
125 bridge
127 protuberance
126 resting surface
128 aperture
132 belt
133 top of belt
123 rest guard
131 inner surface of rest guard
124 angular rest
130 uppermost surface of the angular rest
136 spray applicator bottle
134 trigger mechanism
135 pressure plunger mechanism

What is claimed is:

1. A spray applicator belt hook for supporting an article onto a wearer's belt, the belt hook comprising:

a belt retaining portion including a rear planar wall member having a free end and a first top end, a front planar wall member having a top end and a bottom end, and a bridge member having a planar resting surface; the bridge member integrally connecting to each of the top ends of the first and second wall members to parallely space the first and second wall members from each other, the spacing between the rear wall member and the front wall member and the planar resting surface define an aperture for retaining the wearer's belt therethrough; and an article supporting portion including a planer rest member and a planar rest guard, the planar rest member having an innermost joining portion and an outermost joining portion, the innermost joining portion being integrally joined to the bottom end of the front planar wall member and positioning the planar rest member at an acute angle measured from the planar resting surface of the bridge member, the planar rest guard integrally joined and extending from the outermost joining portion of the planar rest member, the rest guard positioned at a 90 degree angle to the planar rest member, the planar rest member and the rest guard for supporting the article thereto.

2. The belt hook according to claim 1, wherein the acute angle is 25 degrees.

3. The belt hook according to claim 1, wherein the article intended for supporting is a spray bottle.

4. The belt hook according to claim 1, wherein the free end of the planar rear wall member includes a protuberance for fitting beneath a bottom edge of the belt.

5. The belt hook according to claim 1, wherein the belt hook is configured as a left handed spray applicator belt hook or a right handed spray applicator belt hook.

* * * * *